US008959742B2

(12) United States Patent
Petit et al.

(10) Patent No.: US 8,959,742 B2
(45) Date of Patent: Feb. 24, 2015

(54) METHOD FOR DEMOUNTING A TENSIONED CABLE, A SYSTEM AND ASSOCIATED DEVICES

(75) Inventors: Sébastien Petit, Paris (FR); Guy Savoz, Voisins le Bretonneux (FR)

(73) Assignee: Soletanche Freyssinet, Rueil Malmaison (FR)

( * ) Notice: Subject to any disclaimer, the term of this patent is extended or adjusted under 35 U.S.C. 154(b) by 2095 days.

(21) Appl. No.: 11/878,312

(22) Filed: Jul. 23, 2007

(65) Prior Publication Data

US 2008/0028724 A1 Feb. 7, 2008

(30) Foreign Application Priority Data

Aug. 2, 2006 (FR) ..... 06 07078

(51) Int. Cl.
*B61B 7/00* (2006.01)
*E01D 22/00* (2006.01)
*E01D 19/16* (2006.01)

(52) U.S. Cl.
CPC ..... *E01D 22/00* (2013.01); *E01D 19/16* (2013.01)
USPC ..... 29/426.1; 29/426.5; 29/426.6

(58) Field of Classification Search
USPC ..... 29/426.1, 426.3, 426.4, 426.5, 426.6, 29/402.3, 281.1, 281.4, 281.5, 281.6; 52/223.14; 104/112
See application file for complete search history.

(56) References Cited

U.S. PATENT DOCUMENTS

| | | | | |
|---|---|---|---|---|
| 3,381,527 | A * | 5/1968 | Grubbs | 73/862.46 |
| 6,701,599 | B2 * | 3/2004 | Stubler et al. | 29/426.4 |
| 2003/0000414 | A1 * | 1/2003 | Sherman et al. | 104/112 |

FOREIGN PATENT DOCUMENTS

| | | |
|---|---|---|
| FR | 2 745 829 | 12/1997 |
| FR | 2 818 676 | 6/2002 |

OTHER PUBLICATIONS

Marco Petrangeli. "Rehabilitation of Sidi M' Cid Suspension Bridge, Algeria"; Structural Engineering International Apr. 2000.
La Renovation de pont ; Le remplacement de la suspension Travaux 752 Avril 1999.

* cited by examiner

*Primary Examiner* — Christopher Besler
(74) *Attorney, Agent, or Firm* — McKenna Long & Aldridge LLP

(57) ABSTRACT

The invention provides a method for demounting a cable tensioned between a first and second anchorage points on a structure. The method comprises the following steps: slackening the cable so that a running part of the cable is freed from one of said first and second anchorage points; freeing said running part of the cable from the other said first and second anchorage points; supporting said running part of the cable; and removing said running part of the cable away from at least one of said first and second anchorage points.

12 Claims, 7 Drawing Sheets

METHOD FOR DEMOUNTING A TENSIONED CABLE, A SYSTEM AND ASSOCIATED DEVICES

This application claims the benefit of French Patent Application No. 06 07078 filed Aug. 2, 2006 in France, which is hereby incorporated by reference in its entirety.

BACKGROUND OF THE INVENTION

The present invention relates to the demounting of a cable tensioned between two anchorage points on a structure.

Such demounting is often considered as problematic, in particular when no specific device has been provided during the initial design of the structure with which the cable participates.

First of all, the fact that the cable is tensioned between anchorage points prevents it from being freed simply from the structure.

Then, even once the cable has been freed from the structure, it is still likely to damage the latter. If the structure is in service, as in the case of a bridge of which the deck is subject to motor vehicle traffic for example, demounting the cable may also bring about a relatively long interruption of service.

An object of the present invention is to make it possible to demount the cable more easily.

SUMMARY OF THE INVENTION

The invention therefore provides a method for demounting a cable tensioned between a first and a second anchorage point on a structure comprising the following steps:

- freeing a running part of the cable from said first and second anchorage points;
- supporting said running part of the cable; and
- removing said running part of the cable away from at least one of said first and second anchorage points.

According to this method, supporting and removing said running part of the cable are performed with the aid of a plurality of supports distributed along said running part of the cable and forming cradles for said running part of the cable, each held by at least one other cable situated higher than said cable, the cradles being connected to each other and being mounted so that they can move along said other cable.

Advantageously, freeing the running part of the cable from said first and second anchorage points comprises slackening the cable so that the running part of the cable is freed from one of said first and second anchorage points and freeing the running part of the cable from the other of said first and second anchorage points Such preliminary slackening of the cable ensures to free a significant part thereof, with no danger for the close surroundings of the cable, and the support of the running part of the cable also allows to avoid damaging the structure with which the cable participates.

The invention also provides a device for supporting a cable tensioned between a first and second anchorage point on a structure, the support device comprising:

- a plurality of cradles capable of being distributed along a running part of the cable to constitute supports for said running part of the cable;
- means so that each cradle of the plurality rests on at least one other cable situated higher than said cable and can move along said other cable; and
- means connecting the cradles to each other.

The invention also provides a system for demounting a cable tensioned between a first and second anchorage point on a structure, the system including a support device comprising:

- a plurality of cradles capable of being distributed along a running part of the cable to constitute supports for said running part of the cable;
- means so that each cradle of the plurality rests on at least one other cable situated higher than said cable and can move along said other cable; and
- means connecting the cradles to each other, and a bridging device for slackening the tensioned cable, comprising:

- two collars capable of being positioned around the cable so as to ensure substantially non-sliding contact along the cable;
- traction bars connecting said collars;
- means for adjusting the tensile force passing in the traction bars; and
- means for monitoring the tensile force passing in the traction bars.

Other features and advantages of the present invention will become apparent from the following description of examples of non-limiting embodiments, with reference to the appended drawings.

DESCRIPTION OF PREFERRED EMBODIMENTS

The invention is described hereinafter in the non-limiting example of a stay cable. It applies however to any other type of cable tensioned between two anchorage points on a structure (carrying cable of a suspension bridge, prestressing cable, etc).

Figure 1:
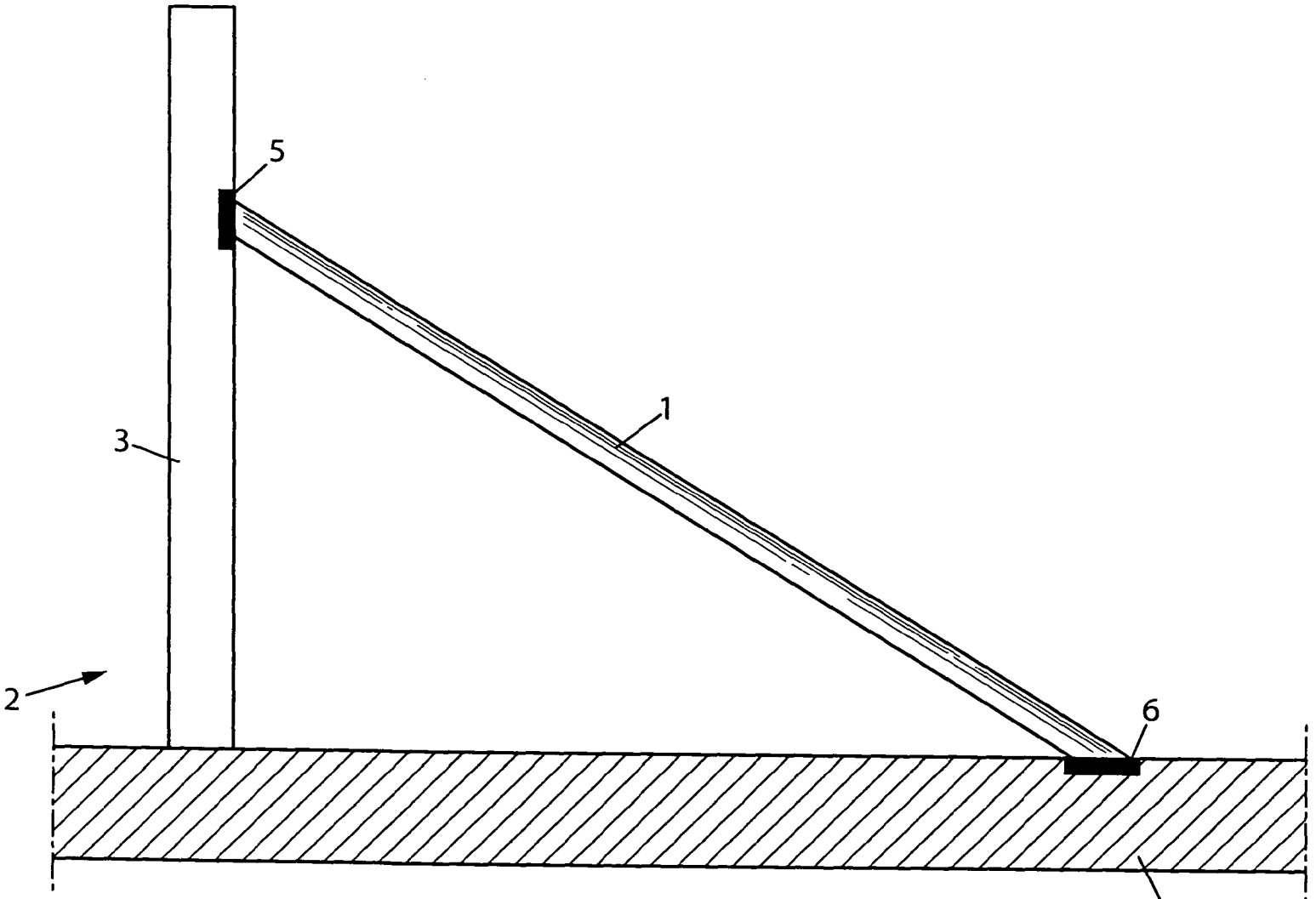
FIG. 1 is a diagram representing an example of a tensioned cable to be demounted.

FIG. 1 shows a stay cable 1 tensioned between two anchorage points on a cable-stayed bridge 2. The first anchorage point 5 is situated on a pylon 3 of the bridge 2, while the second anchorage point 6 is situated on the deck 4 of the bridge 2.

Although not shown in FIG. 1, other cables substantially parallel to cable 1 can be tensioned between the corresponding anchorage points on the bridge 2.

The present invention aims to demount the cable 1 without damaging the bridge 2 or any other cables anchored to the bridge 2.

To this end, the cable 1 may be slackened so that a running part of this cable is freed from the anchor 5 and/or the anchor 6 which connect it to the structure 2.

It will be recalled that freeing a linear structural element composed of one or more metal strands highly tensioned between two points considered to be relatively fixed, as is the case of cable 1 of FIG. 1, is often problematic, in particular when no specific device has been provided during the initial design.

In particular, a reduction in the resisting section of such a cable by cutting it, without taking special precautions, would cause the stresses in the remaining section to increase until the breaking stress of the material is reached. Breakage resulting from this would be sudden and would produce harmful dynamic effects, since the sudden freeing of energy stored in the cable could bring about large rapid uncontrolled deformations ("whip effect") that would be extremely dangerous for the immediate environment of the cable, that is to say for the structure with which the cable participates, but also for the personnel responsible for cutting the cable.

Figure 2:
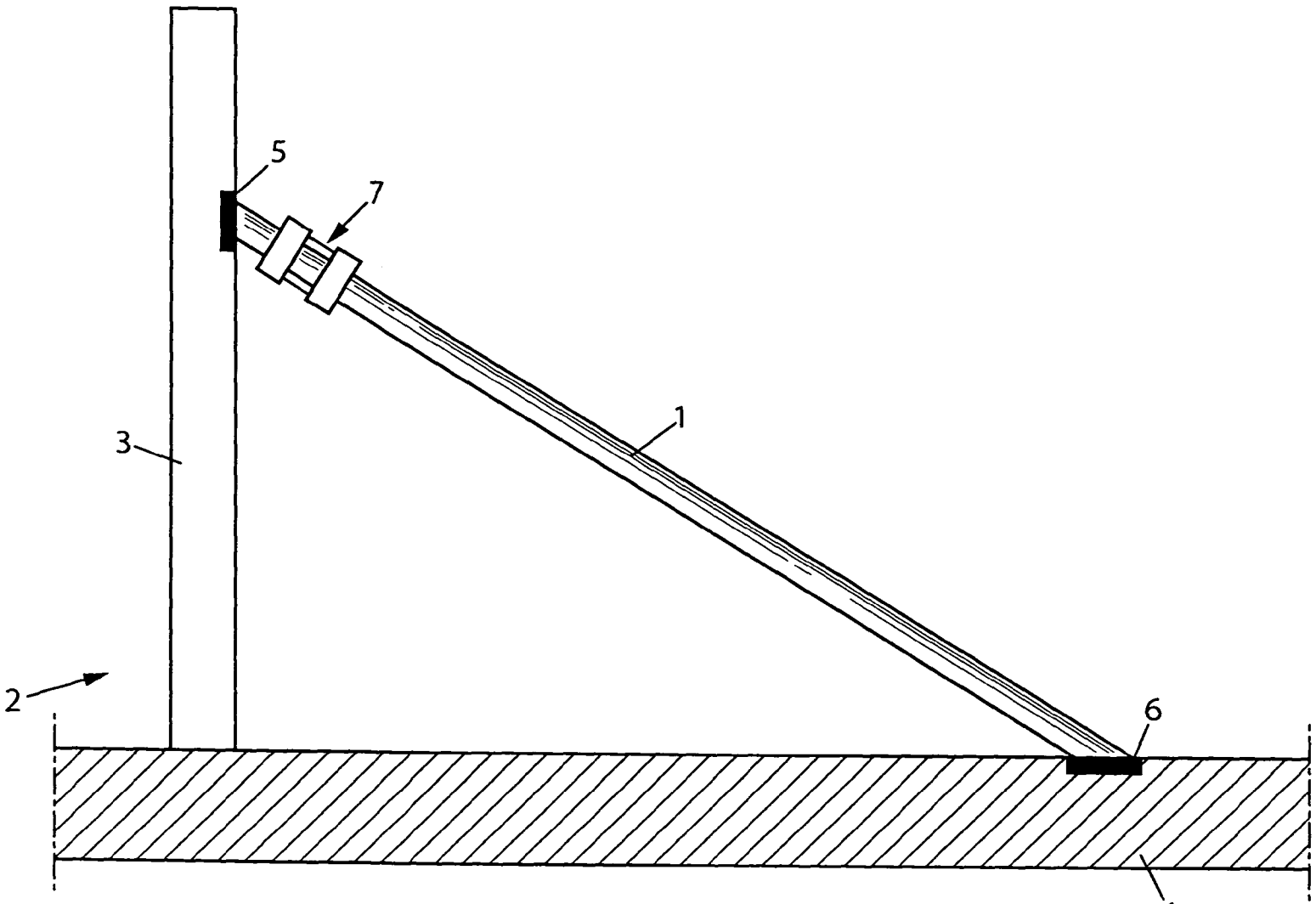
FIG. 2 is a diagram illustrating bridging devices used to slacken the cable of FIG. 1.

Slackening the cable 1 advantageously makes it possible to limit these disadvantages. It could for example be achieved by placing, close to the top anchorage point 5 and/or the bottom anchorage point 6 of the cable 1, a bridging device 7 capable of taking up the tensile force of the cable on a portion thereof (see FIG. 2).

Figure 3:
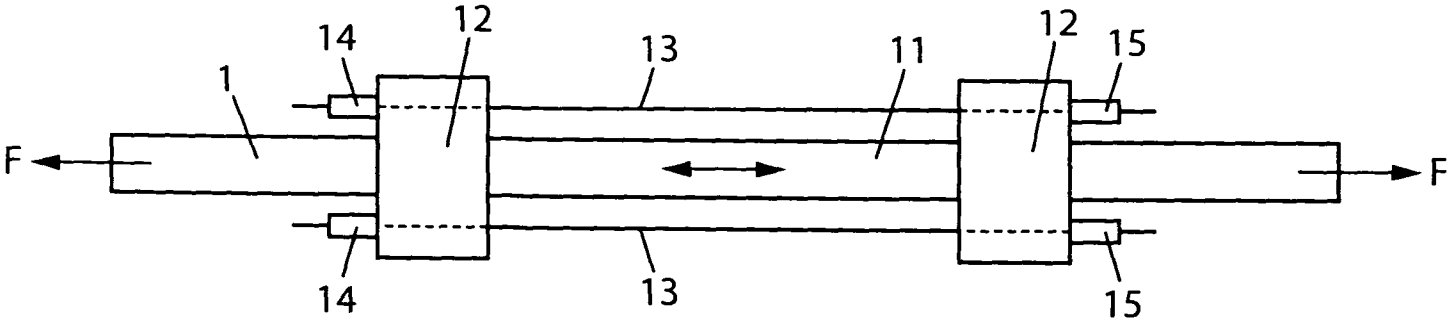
FIGS. 3 to 5 are diagrams showing successive steps for slackening a cable according to an advantageous embodiment of the invention.
Figure 4:
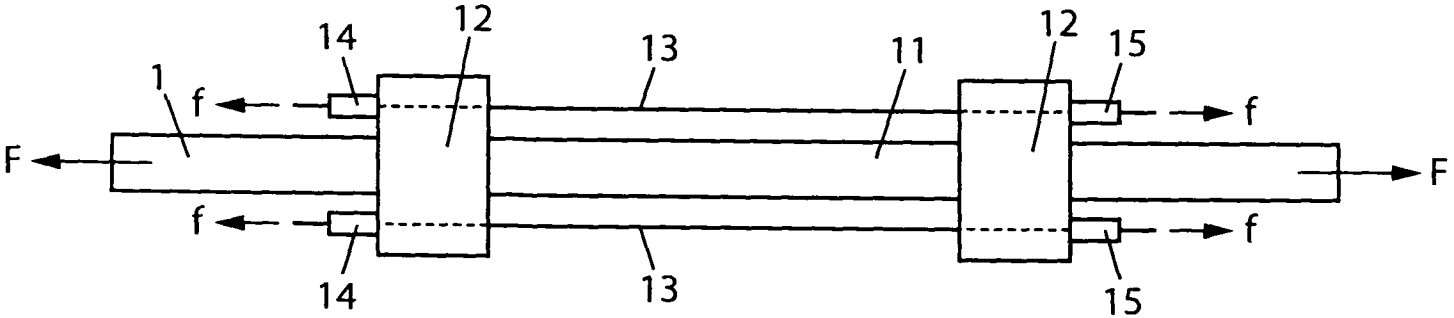
Figure 5:
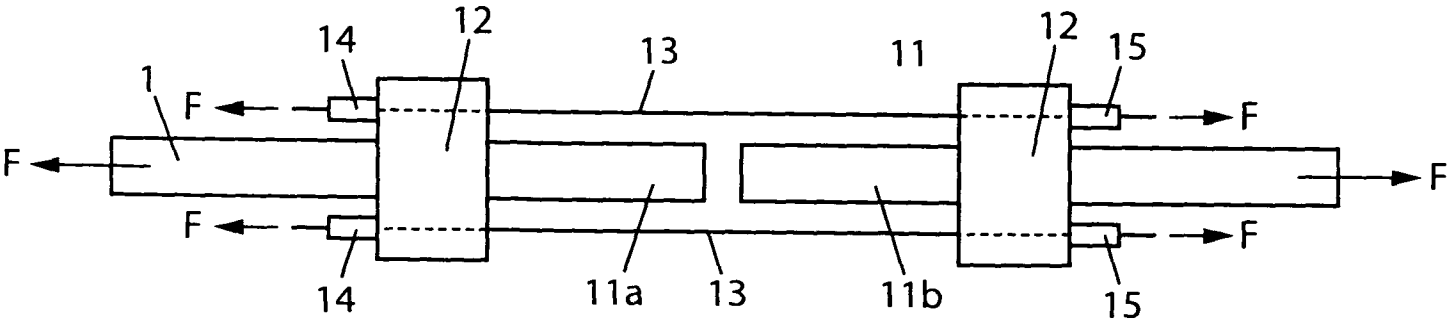

As is apparent in FIGS. 3 to 5, this bridging device 7 may comprise two clamping collars 12 positioned around the cable 1 to provide a structural connection therewith. Each of these collars 12 preferably has the ability to withstand the tensile force F of the cable 1 substantially without sliding along this. In particular, if the cable 1 is provided with a sheath surrounding the metal strands of which it consists, this sheath is advantageously withdrawn at right angles to the collars 12.

In addition, in the example illustrated in FIGS. 3 to 5, the traction bars 13 connect the collars 12 so as to form the actual bridging. The traction bars are advantageously at least two in number and are preferably positioned so that their centre of gravity is situated substantially at the same place as that of the cable 1 to be slackened. They are chosen so as to be capable of withstanding the tensile force F to which the cable 1 is initially subjected.

In the example illustrated in FIGS. 3 to 5, the means 14 for adjusting the tensile force passing through the traction bars 13 have been shown. The means for adjustment 14 may for example comprise jacks.

In addition, the means 15 for monitoring the tensile force passing in the traction bars may also be used. In the figures, the means 14 for adjusting, and the means 15 for monitoring the tensile force have been shown close to the opposite ends of the traction bars 13. It will however be understood that such means can be positioned differently, for example on the same side of the traction bars.

In the step illustrated in FIG. 3, the cable 1 is subjected to the tensile force F which corresponds to the initial tension of the cable over all its length comprised between the anchorages 5 and 6. At this stage, the tensile force in the bridging device is nil or virtually nil.

Subsequently, the traction bars 13 of the bridging device 7 are tensioned (which is symbolised in FIG. 4 by the tension f) until the sum of their tensions reaches a value greater than or equal to an assumed value for the tensile force F of the cable 1. Of course, if the value of the tensile force F is known, it will be possible to tension the traction bars 13 in order to reach this value precisely.

Following this operation, the force F has been totally transferred to the portion under consideration 11 of the cable 1 to the corresponding bridging device 7. The portion 11 of the cable is then subjected to a force that is virtually nil.

On account of this, said portion 11 of the cable placed between the clamping collars 12 may then be divided into sections without danger, as illustrated in FIG. 5. Division of the portion 11 of the cable into two sub-portions 11*a* and 11*b* may be achieved in different ways, for example by successively cutting each strand of the cable 1 or by localised intensive heating of this portion of the cable until it breaks.

During the step of dividing the cable into sections, it may be advantageously verified, with the aid of the monitoring means 15, that the tensile force in the bridging device varies relatively little. This guarantees in point of fact that the bridging device has indeed locally taken up all the tensile force F to which the cable 1 was initially subjected.

Once the cable 1 has been divided into sections, the tensile force in the bridging device can be progressively released until annulled with the aid of the means for adjustment 14. The consequence of this is to slacken the cable 1 in its entirety. The means 15 for monitoring the tensile force can advantageously be used to check this operation.

It will thus be understood that the cable 1 has been slackened without any sudden variation in force having been encountered, since division of the cable into sections took place in a portion where its stressed state was virtually nil.

Following the advantageous operations described above, the running part of the cable 1 is freed from the top anchor 5 and/or the bottom anchor 6. When slackening has been achieved close to only one of these anchorage points, for example the bottom anchorage point 6 which is the more accessible, the running part of the cable is then freed from the other anchorage point, for example the anchorage point 5. This second freeing may be achieved for example by simply dividing said portion of the cable close to the other anchorage point. No bridging device is necessary for this cutting which does not present any danger, the cable having already been slackened. As a variant, freeing of the running part of the cable from the other anchorage point could result from withdrawal of said cable from said other anchor. The running part of the cable is then totally freed from the top 5 and bottom 6 anchors (as symbolised by the crosses close to these anchors in FIGS. 6 and 7).

The running part of the cable 1 is then supported so as not to sag under the effect of its own weight, which would risk damaging the deck 4 of the bridge 2 and the other cables which may be situated under the cable 1.

Figure 6:
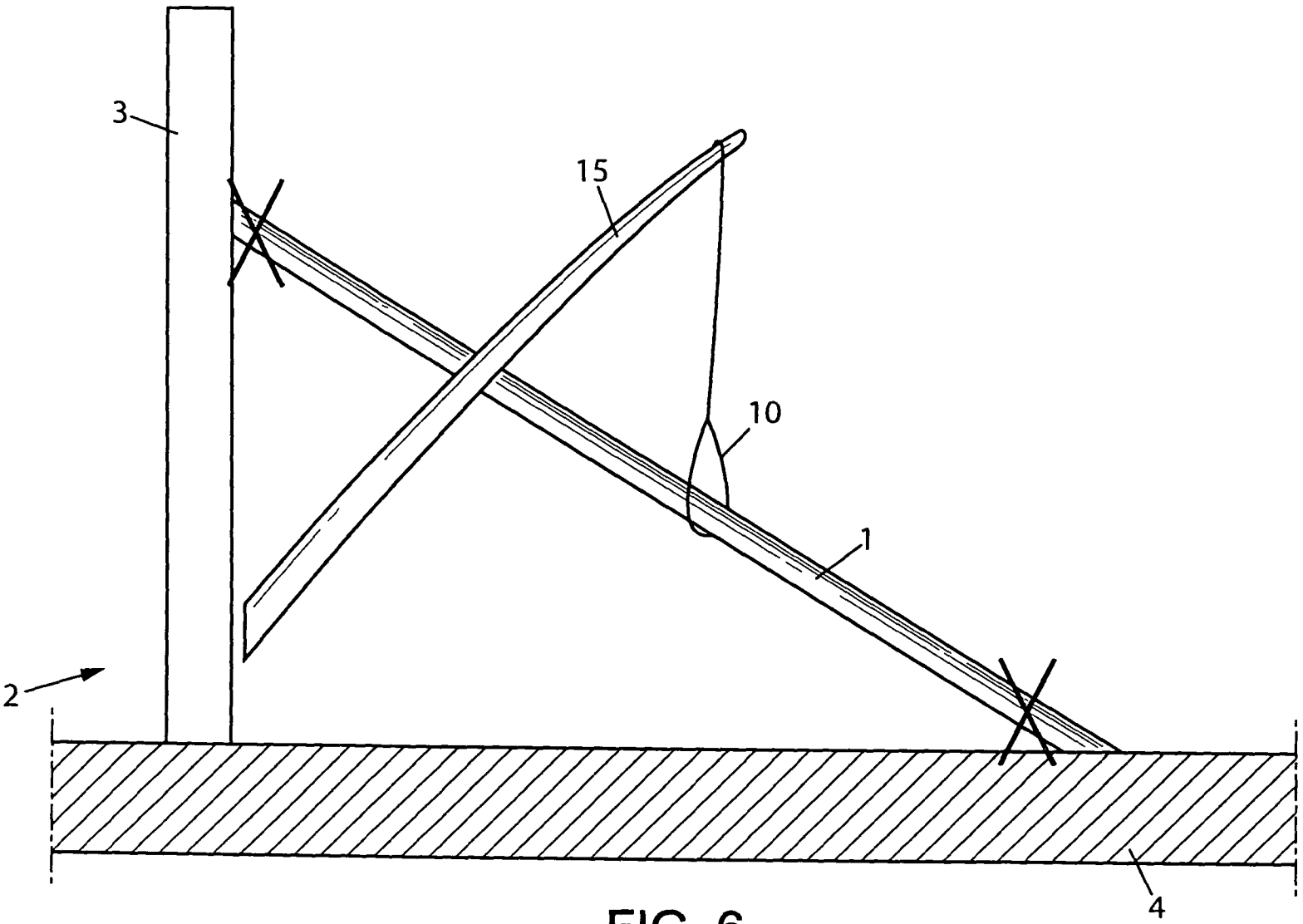
FIG. 6 is a diagram showing a procedure for supporting the cable of FIG. 1 once slackened.

In an example illustrated in FIG. 6, the running part of the cable 1, once slackened, is supported with the aid of the support 10 on which it partly rests, this support 10 being itself held by an auxiliary structure 15 of the crane or scaffolding tower type for example. Thus, the running part of the cable is lifted locally in the region of the support 10, which ensures that it is held while waiting to be removed.

Figure 7:
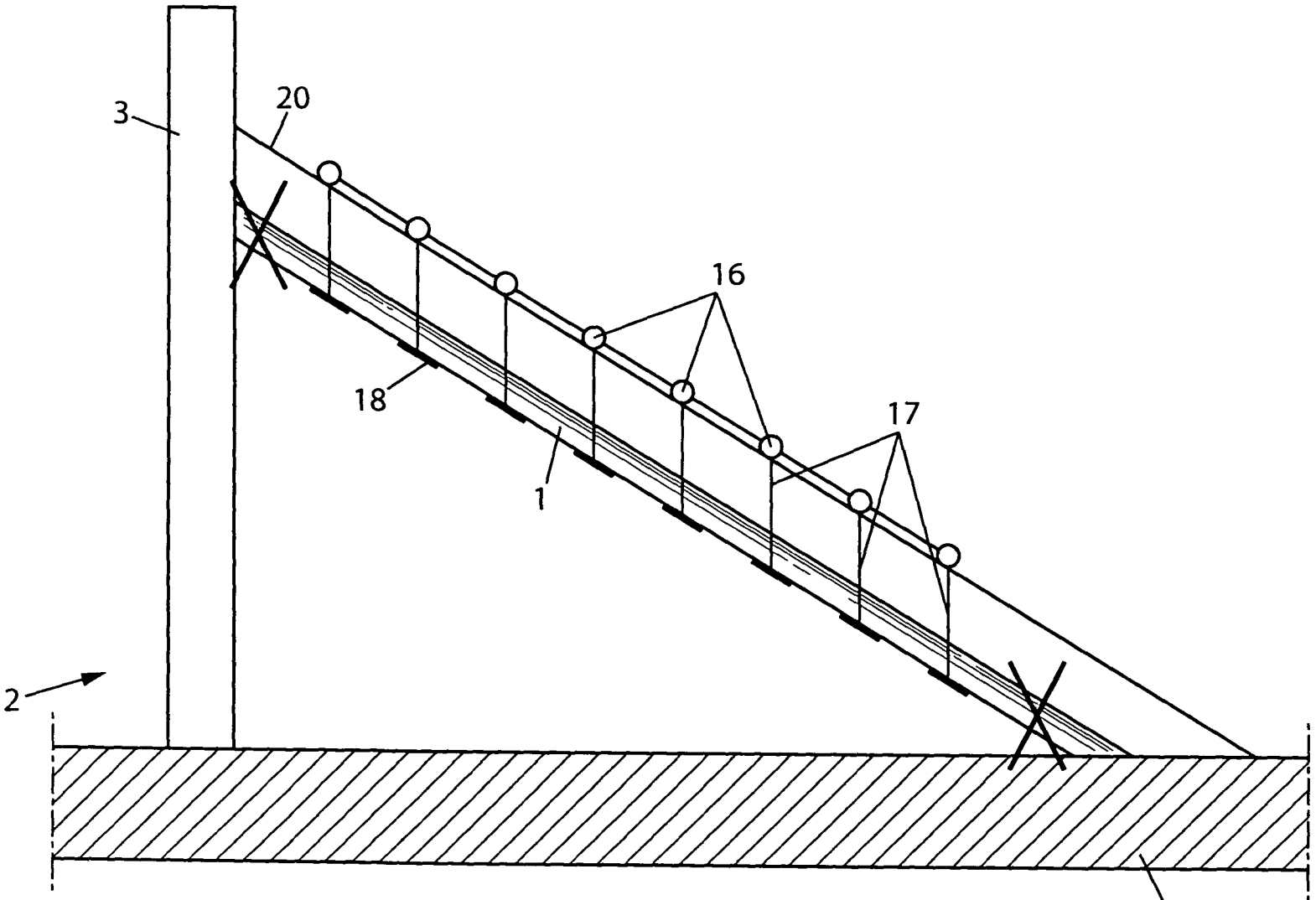
FIG. 7 is a diagram showing another procedure for supporting the cable of FIG. 1 once slackened.

FIG. 7 illustrates another example in which a plurality of supports 18 support the running part of the cable 1 while waiting for it to be removed. These supports 18 are advantageously distributed, possibly in a uniform manner, over all the length of the running part of the cable 1.

Figure 8:
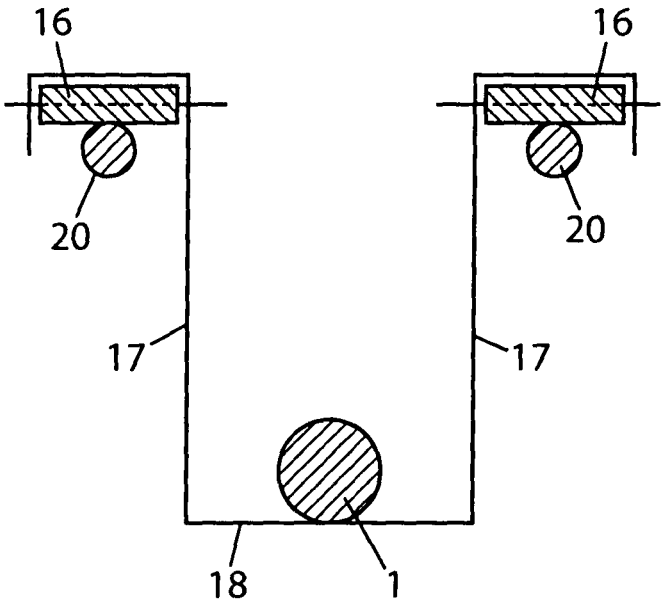
FIG. 8 is a transverse view of part of the support device used according to the support procedure of FIG. 7.

The supports 18 advantageously form cradles receiving the running part of the cable 1 as illustrated in FIG. 8. They are held by one or more cables 20 situated higher than the cable 1, to which they are connected via the hangers 17 for example. In the example illustrated in FIG. 8, the cradles 18 are thus suspended so as to rest on two cables 20 situated either side of the cable 1.

The cradles 18 are advantageously connected together and mounted so as to be able to move along the cables 20. In the example illustrated, this movement is ensured by the rollers 16 to which the hangers 17 are connected and which are capable of rolling on the cables 20.

The cables 20 which ensure that the cradles 18 are held in place may be cables of which the structure 2 consists, for example stay cables permanently tensioned between the pylon 3 and the deck 4 of the bridge 2, in the manner of the cable 1.

As a variant, these cables 20 can be provisionally mounted on the structure 2 so as to support the cable 1 to be demounted. In this case, it will be possible for the cables 20 to be anchored in anchorage blocks provisionally connected to the pylon 3 and the deck 4, rather than directly in the pylon 3 and the deck 4. These anchorage blocks are then placed close to the anchorage points 5 and 6 of the cable 1. In this way, the provisional cables 20 can be withdrawn from the structure 2, once the cable 1 has been demounted.

When the support device described with reference to FIGS. 7 and 8 is used, the sequence for demounting the slackened cable 1 can then proceed in the following manner.

Figure 9:
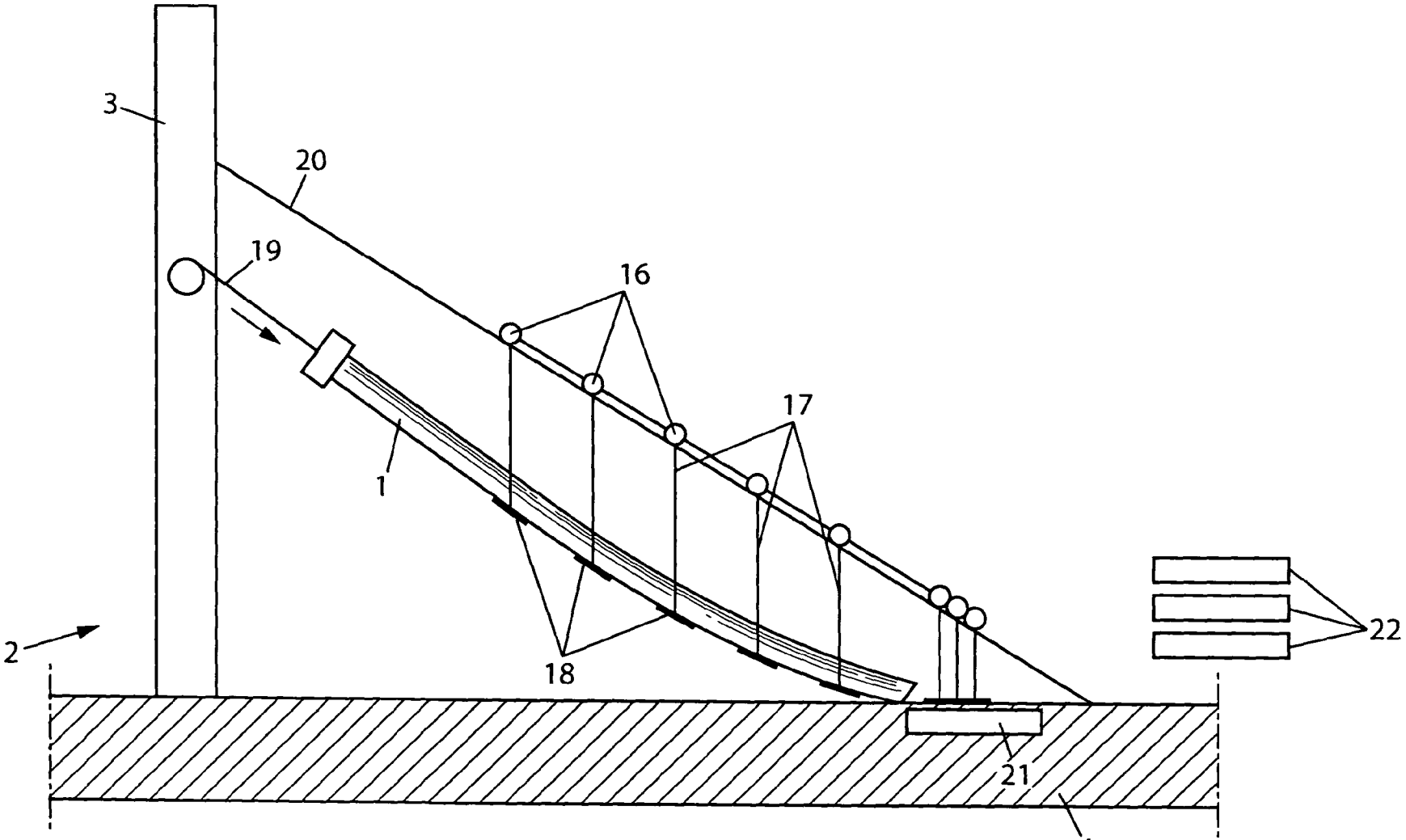
FIG. 9 is a diagram showing an intermediate step for removing the cable of FIG. 1 according to an advantageous embodiment of the invention.

The assembly composed of the running part of the cable 1 and the cradles 18 on which this part of the cable 1 rests is allowed to descend progressively. Progressive descent is advantageously achieved using the means 19 capable of holding the running part of the cable 1, as illustrated in FIG. 9. A controlled delivery cable connected to the cable 1 can for example consist of such holding means 19. As a variant or a complement, the holding means can be positioned so as to control the descent of the cradles 18.

During the descent, the rollers 16 roll over the cables 20, which causes the cradles 18 and the running part of the cable 1 which they support to be entrained towards the deck 4 of the bridge 2. In this way removal of the running part of the cable 1 is ensured away from the top anchor 5 by which the cable 1 was initially fixed to the pylon 3 of the bridge 2.

It will moreover be noted that parts of the cable 1 remaining fixed to the top 5 and bottom 6 anchors, after freeing the running part of the cable 1, will be advantageously withdrawn from their respective anchors in order to be removed.

Advantageously, the running part of the cable 1 can be divided into sections during its removal. This can be achieved by cutting the cable 1 into elements with a reduced length, preferably lengths that can be easily transported by road, as the cable descends towards the deck 4 of the bridge 2.

FIG. 9 illustrates an intermediate step in the demounting of the cable 1, in which a new element 21 has been obtained by cutting the portion of the cable 1 which has just arrived close to the deck 4. As regards the elements 22, these represent elements of the previously cut cable 1 that are collected together substantially in the same place with a view to their possible final removal away from the bridge 2.

The demounting process is then continued in the same way until the running part of the cable 1 has fully descended to the deck 4 of the bridge 2 and possibly been cut into elements of reduced length 22. The elements 22 obtained may then be removed away from the bridge 2.

At the conclusion of these operations, all the supports 18, hangers 17 and rollers 16 are collected together close to the deck 4 of the bridge 2. They can then be recovered so as to serve in demounting another cable. When the cables 20 are provisional, they can in their turn be withdrawn from their anchors.

Easy demounting of the cable 1 can be obtained in this way, without this cable damaging the structure 2, or any other stays of the bundle to which the cable 1 belongs. Moreover, disruption to the traffic on the bridge 2 is minimized as the cable 1 is demounted. In addition, demounting can be carried out without any means having been provided for this purpose when the structure 2 was designed.

It will be noted in particular that the support device described with reference to FIGS. 7 to 9 is particularly advantageous since it comprises light means capable of contributing to the support and also removal of a large part of the cable, in spite of the large weight of the cable and of the great height of the top anchor 5 to which the cable 1 was initially fixed.

The invention claimed is:

1. Method for demounting a cable tensioned between a first and a second anchorage point on a structure comprising the following steps:

freeing a running part of the cable from said first and second anchorage points;

supporting said running part of the cable; and removing said running part of the cable away from at least one of said first and second anchorage points, wherein supporting and removing said running part of the cable are performed with the aid of a plurality of supports distributed along said running part of the cable and forming cradles for said running part of the cable, each held by at least one other cable situated higher than said cable, the cradles being connected to each other and being mounted so that they can move along said other cable.

2. Method according to claim 1, in which said other cable is tensioned between the anchorage points on said structure.

3. Method according to claim 2, in which said other cable is provisionally anchored close to said first and second anchorage points, with the aim of maintaining the cradles.

4. Method according to claim 1, in which movement of the cradles along said other cable is ensured with the aid of rollers.

5. Method according to claim 1, in which the first anchorage point is situated higher than the second anchorage point and in which removal of said running part of the cable away from at least one of said first and second anchorage points comprises the descent of said running part of the cable substantially to the height of the second anchorage point, descent of said running part of the cable being controlled with the aid of means for holding said running part of the cable and/or the cradles.

6. Method according to claim 1, in which said running part of the cable is divided into sections as it is removed.

7. Method according to claim 1, in which freeing the running part of the cable from said first and second anchorage points comprises slackening the cable so that the running part of the cable is freed from one of said first and second anchorage points and freeing the running part of the cable from the other of said first and second anchorage points.

8. Method according to claim 7, in which slackening the cable comprises the following steps, carried out close to the first and/or the second anchorage points:

placing on a portion of the cable a bridging device capable of taking up the tensile force of the cable on said portion;

tensioning the bridging device to a value greater than or equal to an assumed value for the tensile force of the cable, so as to annul the tensile force of the cable on said portion; and dividing said portion of the cable into sections.

9. Method according to claim 8, in which the tension is then annulled in the bridging device.

10. Method according to claim 8, in which placement of the bridging device comprises positioning two collars of the bridging device around the cable so as to provide substantially non-sliding contact of the collars along the cable and in which the tensioning of the bridging device comprises tensioning traction bars of the bridging device connecting said collars.

11. Method according to claim 8, in which the tensile force in the bridging device is checked with the aid of a monitoring means as the bridging device is tensioned and/or when said portion of the cable is divided into sections.

12. Method according to claim 1, in which said cable is a stay cable.

* * * * *